US005743179A

United States Patent [19]

Pohl

[11] Patent Number: 5,743,179

[45] Date of Patent: Apr. 28, 1998

[54] FRAMELESS HIGH PRESSURE PLATEN PRESS

[76] Inventor: Andrew P. Pohl, 5721 B Bayside Rd., Virginia Beach, Va. 23455

[21] Appl. No.: 721,869

[22] Filed: Sep. 27, 1996

[51] Int. Cl.[6] ..... B30B 15/34; B30B 7/02; B30B 5/00

[52] U.S. Cl. ..... 100/325; 100/199; 100/278; 100/338; 100/407; 100/450.1

[58] Field of Search ..... 100/199, 212, 100/264, 270, 278, 279, 317, 325, 326, 101; 425/338, 407, 450.1

[56] References Cited

U.S. PATENT DOCUMENTS

| | | | |
|---|---|---|---|
| 110,849 | 1/1871 | Hamilton | 100/278 |
| 211,599 | 1/1879 | Smithson | 100/279 |
| 3,209,405 | 10/1965 | Loewenfeld | 100/199 |
| 3,371,380 | 3/1968 | Bruder et al. | 100/199 |
| 4,608,922 | 9/1986 | Pohl | 100/278 |
| 5,234,332 | 8/1993 | Hoenke et al. | 100/199 |

FOREIGN PATENT DOCUMENTS

| | | | |
|---|---|---|---|
| 203778 | 10/1956 | Australia | 100/270 |
| 1092640 | 11/1960 | Germany | 100/199 |
| 1198528 | 8/1965 | Germany | 100/199 |
| 3419123 | 11/1985 | Germany | 100/278 |
| 740525 | 6/1980 | U.S.S.R. | 100/278 |
| 1425095 | 9/1988 | U.S.S.R. | 100/278 |

*Primary Examiner*—Stephen F. Gerrity
*Attorney, Agent, or Firm*—Merchant Gould Smith Edell Welter & Schmidt

[57] ABSTRACT

The present invention relates generally to a frameless high pressure press. The high pressure press includes first and second opposed plates that are at least partially surrounded by a wrapping structure. A lift device is positioned on one of the first and second plates at a location offset from the wrapping structure. The press also includes a linkage structure that transfers force generated by the lift device to the wrapping structure such that the wrapping structure forces the plates together. The linkage structure includes a tensioning member connected to the wrapping structure and generally transversely aligned with respect to the plates. The linkage structure also includes a cross member that extends between the lift device and the tensioning mechanism. The length of the tensioning member can be adjusted to control the level of force multiplication generated by the press. Also, the tensioning member is pivotally connected to both the wrapping structure and the cross member to prevent side loading of the lift device.

20 Claims, 3 Drawing Sheets

FRAMELESS HIGH PRESSURE PLATEN PRESS

FIELD OF THE INVENTION

The present invention relates generally to presses. More particularly, the present invention relates to high pressure platen presses utilized in the formation of products such as of decorative laminates, high density board and chip board, and in the processing of low viscosity materials such as thermoplastic composites.

BACKGROUND OF THE INVENTION

High pressure platen presses are well known in the art. Nearly without exception these presses are built from three components: upper and lower press plates of which at least one is to be raised or lowered; a lift device for forcing the above-mentioned press plates together; and a frame that counteracts all of the bending moments created by the above-mentioned lift device. Due to the large bending moments created by the lift device, a substantially reinforced frame is typically utilized in association with the lift device.

U.S. Pat. No. 4,608,922, which is hereby incorporated by reference, discloses various frameless press embodiments. FIGS. 1 and 2 illustrate a frameless press 18 representative of the frameless presses disclosed in U.S. Pat. No. 4,608,922. Generally, the press 18 includes first and second opposing plates 20 and 22 that are surrounded by a wrapping structure 24. A lift device 26 such as a hydraulic cylinder is positioned on the first plate 20 at a location directly beneath the wrapping structure 24. When the lift device 26 pushes upward on the wrapping structure 24, the wrapping structure 24 is tensioned and the plates 20 and 22 are forced together. A significant advantage provided by frameless presses is a substantial reduction in materials cost as compared to conventional framed presses.

A problem associated with existing frameless presses relates to the orientation of the lift device 26 beneath the wrapping structure 24. To accommodate the height of the lift device 26, the wrapping structure 24 must be aligned at an angle θ with respect to the first plate 20. It will be appreciated that as the angle θ increases, the power multiplication of the press is reduced. For example, when θ equals 15 degrees, the force generated by the lift device is multiplied ten fold by the press. In contrast, when θ equals 50 degrees, the force generated by the lift device is only multiplied three times by the press. Consequently, there is a strong incentive to minimize the angle θ of the wrapping structure 24. The placement of the lift device 26 beneath the wrapping structure 24 interferes with the goal of minimizing the angle θ of the wrapping structure 24.

Another problem experienced by existing frameless presses relates to excessive wear of the lift devices. As shown in FIG. 2, during the pressing process, any misalignment between the plates 20 and 22 causes a side load to be transferred to the lift device 26. The side loading of the lift device 26 causes excessive wear of the lift device 26 during normal operating conditions.

A significant use for presses relates to the processing of thermoplastic-composites for the recycling industry. Thermoplastic-composites typically have low viscosity characteristics and generally need to be rapidly cooled after being formed by a molding/shaping process. Such physical attributes of thermoplastic-composites makes processing thermoplastic-composites via a frameless press difficult. Specifically, due to the low viscosity of thermoplastic composites, a large press force is typically required to process a thermoplastic-composite within a mold. The large force exerted on the thermoplastic material generates significant bursting power that must be resisted by the mold. Consequently, the mold must have extremely thick walls. However, the extreme thickness of the walls interferes with the ability to effectively cool the thermoplastic material. Consequently, what is needed is a frameless high pressure platen press configured to effectively process thermoplastic-composite materials.

SUMMARY OF THE INVENTION

The present invention relates generally to a frameless high pressure press. The high pressure press includes first and second opposed plates that are at least partially surrounded by a wrapping structure. A lift device is positioned on one of the first and second plates at a location offset from the wrapping structure. The press also includes a linkage structure that transfers force generated by the lift device to the wrapping structure such that the wrapping structure forces the plates together. The linkage structure includes a tensioning member connected to the wrapping structure and generally transversely aligned with respect to the plates. The linkage structure also includes a cross member that extends between the lift device and the tensioning mechanism. Because the lift device is offset from the wrapping structure, the angle defined between the wrapping structure and the plate is not dependent upon or constrained by the physical height of the lift device.

In a preferred embodiment, the length of the tensioning member can be adjusted to control the level of force multiplication generated by the press. Also in the preferred embodiment, the tensioning member is pivotally connected to both the wrapping structure and the cross member. The pivotal connection of the tensioning member allows the tensioning member to tilt or pivot in response to side loads generated by the wrapping structure. In this manner, the pivoted tensioning member functions to prevent excessive wear of the lift device.

In one embodiment of the present invention, the high pressure press is equipped with a pressure chamber for facilitating processing very low viscosity material such as thermoplastic-composite materials. The pressure chamber allows such low viscosity materials to be processed without requiring molds having extremely thick walls.

In a further embodiment of the present invention, the press includes a heating station and a cooling station that are concurrently activated by the wrap member and the lift device. Both the heating station and the cooling station include pressure chambers to facilitate processing low viscosity materials. In use, molds can systematically be transferred from the heating station to the cooling station. The ability to move molds and heated composite material from a permanently heated station to a permanently cooled station during the same cycle results in considerable energy and process-time savings.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
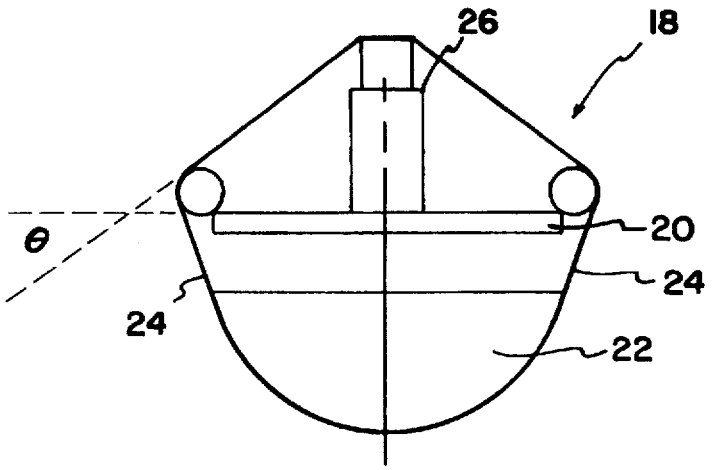
FIG. 1 PRIOR ART
FIG. 1 illustrates an exemplary frameless press that is known in the prior art.
Figure 2:
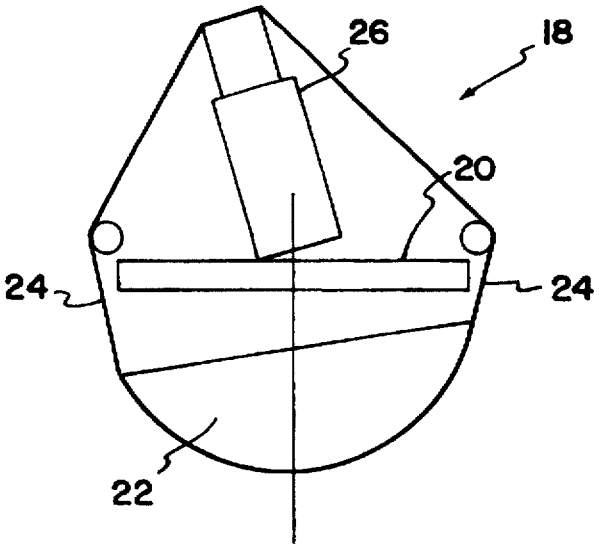
FIG. 2 PRIOR ART
FIG. 2 illustrates the press of FIG. 1 experiencing side loading of the lift device.
Figure 3:
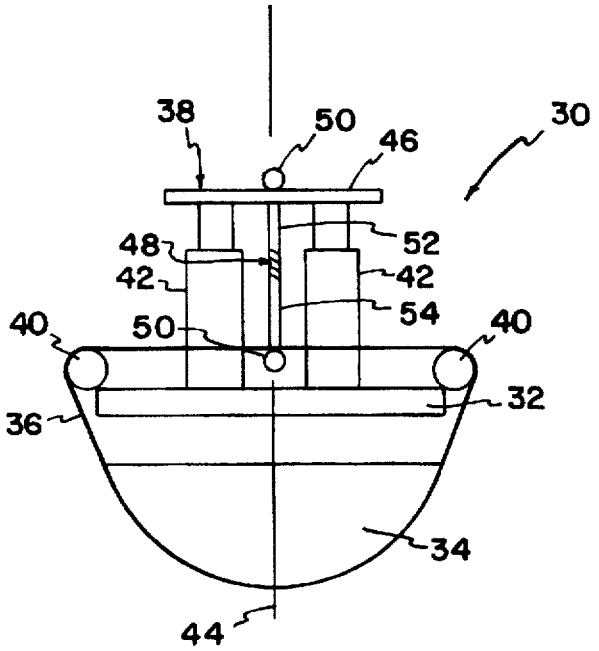
FIG. 3 illustrates a frameless press constructed in accordance with the principles of the present invention shown in an open configuration.
Figure 4:
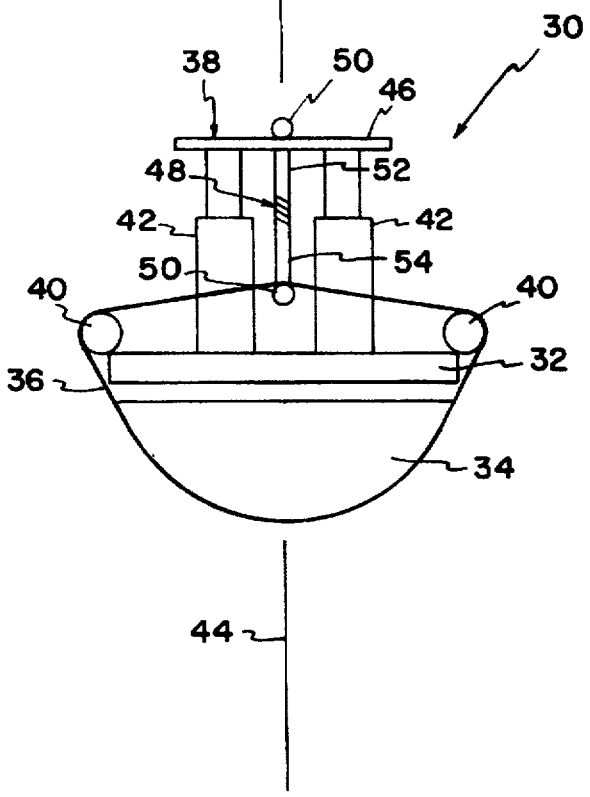
FIG. 4 illustrates the frameless press of FIG. 3 in a closed configuration.

FIGS. 3 and 4 illustrate an exemplary frameless press 30 constructed in accordance with the principles of the present invention. The press 30 includes a first plate 32 positioned opposite from a second plate 34. A wrapping structure 36 surrounds the first and second plates 32 and 34. A lift assembly 38 is shown positioned on the first plate 32. The lift assembly 38 is configured to apply an upward tensioning force to the wrapping structure 36. When the upward tensioning force is applied to the wrapping structure 36, the first and second plates 32 and 34 are forced together, causing the plates 32 and 34 to move from an open position (as shown in FIG. 3) to a closed position (as shown in FIG. 4).

As shown in FIGS. 3 and 4, the first plate 32 of the press 30 is shown as a top press plate having a generally rectangular cross section. Conventional roller bearings 40 are mounted at the upper corners of the first plate 32 to guide the wrapping structure 36 about the first plate 32. Typically, the first plate 32 is connected to a conventional support structure (not shown), such as a floor stand, for supporting the press 30 above a ground surface. It is preferred for the first plate 32 to be made of a rigid material such as steel.

The second plate 34 of the press 30 is shown as a bottom plate or belly having a flat upper surface opposite a curved lower surface. The curved lower surface is configured for guiding the wrapping structure 36 around the bottom of the second plate 34. The second plate 34 is also preferably made of a rigid material such as steel.

The wrapping structure 36 of the press 30 is preferably made of a flexible and relatively strong material such as steel. Exemplary structures suitable for use as the wrapping structure 36 include ropes, sheets, cables, or belts. It is preferred for the wrapping structure 36 to completely surround the first and second plates 32 and 34. However, in certain embodiments of the present invention, the wrapping structure 36 might only partially surround the plates 32 and 34. It is also preferred for the wrapping structure 36 to be aligned or centered upon geometric center lines of the plates 32 and 34. It will be appreciated that multiple wrapping structures may be used in association with the present invention. If multiple belts are used, it is preferred for the net resultant forces generated by the belts to pass through the geometric center lines of the plates 32 and 34.

The illustrated lift assembly 38 of the press 30 includes first and second spaced apart lift units 42. Exemplary lift units include hydraulic or pneumatic rams or cylinders, air bags, water expansion units, mechanical jacks, or any other known mechanical or manual devices capable of generating a lifting force sufficient for the purposes of the press. The lift units 42 are preferably laterally or horizontally offset from the wrapping structure 36 and are located on opposite sides of a center line 44 of the first and second plates 32 and 34. The lift units 42 are preferably spaced equal distances from the center line 44 such that a net resultant force generated by the lift units 42 passes through the center line 44.

The lift assembly 38 also includes a linkage structure connecting the lift units 42 to the wrapping structure 36. The linkage structure is shown including a cross member 46 or plate that extends between the first and second lift units 42. The cross member 46 is preferably aligned generally parallel to the first and second plates 32 and 34. The linkage structure also includes an elongate tensioning member 48 connecting the cross member 46 to the wrapping structure 36. The elongate tensioning member 48 is preferably longitudinally alignable generally along the center line 44 of the plates 32 and 34 and is preferably generally transversely aligned with respect to the first plate 32.

In a preferred configuration, the tensioning member 48 is pivotally connected to the cross member 46 and the wrapping structure 36 by conventional roller bearings 50. The roller bearings 50 allow the tensioning member 48 to tilt or pivot in response to side loading from the wrapping structure 36. The pivoting action of the tensioning member 48 prevents side loads from being transferred to the lift units 42 thereby preventing excessive wearing of the lift units 42.

The tensioning member 48 preferably includes a first portion 52 that is threadingly connected to a second portion 54. The threaded connection between the first and second portions 52 and 54 of the tensioning member 48 allows the length of the tensioning member 48 to be adjusted by rotating the first and second portions 52 and 54 with respect to each other. By adjusting the length of the tensioning member 48, the power multiplication generated by the press 30 can be controlled.

It will be appreciated that the number and arrangement of the lift units can be varied without departing from the principles of the present invention. For example, a preferred arrangement includes four lift units. In such an arrangement, two lift units are preferably located on each side of the wrapping structure and the cross plate bridges over the top of the wrapping member between the two sets of lift units. In essence, such an arrangement results in the lift assembly straddling the wrapping structure. In an alternative arrangement, a single lift unit may be located on each side of the wrapping structure. In another alternative arrangement, the lift units may be located on a single side of the wrapping structure and the cross member is arranged in a cantilever configuration.

In general operation, an object desired to be compressed (not shown) is first placed between the plates 32 and 34 while the press 30 is open. Once the object is in the press 30, the lift units 42 are activated so as to generate an upward tensioning force. The upward tensioning force is transferred to the wrapping structure 36 via the cross member 46 and the tensioning member 48. As the wrapping structure 36 is tensioned by the tensioning member 48, the first and second plates 32 and 34 are forced together from the open position (shown in FIG. 3) toward the closed position (shown in FIG. 4). It will be appreciated that when the press 30 is in the open position, the top portion of the wrapping structure 36 is substantially parallel with the first plate 32. Such a parallel configuration maximizes the pressing power of the press 30. In the closed position shown in FIG. 4, the top portion of the wrapping structure 36 forms a slightly oblique angle with respect to the first plate 32.

Figure 5:
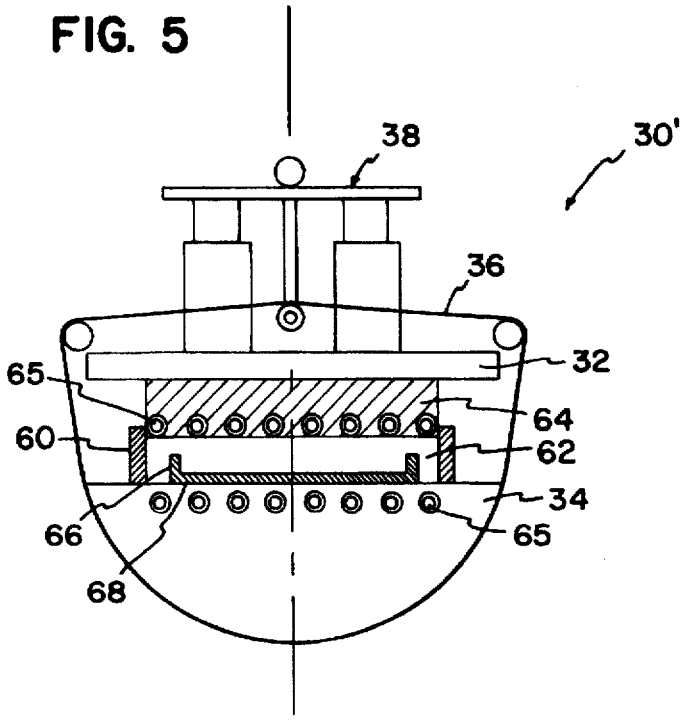
FIG. 5 illustrates an alternative frameless press constructed in accordance with the principles of the present invention, the press being equipped with a pressure chamber for facilitating processing low viscosity materials.

FIG. 5 shows a frameless press 30' constructed in accordance with the principles of the present invention. Similar to the aforementioned press 30, the press 30' includes top and bottom plates 32 and 34, wrapping member 36 and lift assembly 38. The bottom plate 34 of the press 30' includes a wall structure 60 projecting upward from the top surface of the plate 34. The wall structure 60 and the top surface of the bottom plate 34 cooperate to define an inner chamber 62. The sides of the chamber 62 are enclosed by the wall structure 60 while the bottom of the chamber 62 is enclosed by the bottom plate 34. The top of the chamber 62 is open and configured to reciprocally receive a press member 64 connected to the bottom surface of the top plate 32. The press member 64 of the top plate 32 is sized to slide tightly within the inner chamber 62 of the bottom plate 34 when the press 30' is closed. The top and bottom plates 32 and 34 are equipped with conventional heating elements 65 for heating the inner chamber 62.

A preferred use for the press 30' involves the shaping of low viscosity materials such as thermoplastic-composites. While the press 30' is in an open position, a mold structure including a cutting frame 66 and a shaping insert 68 is preferably placed within the chamber 62 of the press 30'. Next, the chamber 62 is at least partially filled with thermoplastic-composite material. Once the composite material has been place in the chamber 62, lift assembly 38 is activated causing the plates 32 and 34 to move toward one another. As the plates move toward one another, the press member 64 of the top plate 32 slides tightly within the wall structure 60 of the bottom plate 34. The space between the press member 64 and the wall structure 60 of the bottom plate 34 is large enough to let air escape but small enough to prevent the composite material from exiting the chamber 62. In this manner, the press member 64 and the wall structure 60 of the bottom plate 34 cooperate to produce a pressure chamber.

As the first and second plates 32 and 34 continue to be pushed together by the wrapping structure 36, the composite material is compressed within the chamber 62 and heated/melted via the heating elements 65. The melted and compressed composite material flows within the chamber 62 to fill the void areas located around the exterior of the cutting frame 66 and also within the interior of the cutting frame 66 above the shaping insert 68. Because the composite material is compressed on both the interior and exterior of the cutting frame 66, the cutting frame 66 is pressure balanced. Consequently, despite the large bursting power generated by the composite material within the chamber 62, the cutting frame 66 of the mold does not require thick walls.

As the composite material is compressed within the cutting frame 66, the shaping insert 68 forms the material into a desired three-dimensional shape. When the press member 64 of the top plate 32 reaches the top of the cutting frame 66, the composite material within the cutting frame 66 is calibrated and trimmed automatically by the engagement between the cutting frame 66 and the press member 64. If desired, it will be appreciated that the press member 64 can also be equipped with a second shaping insert such that both the top and bottom sides of the composite material are shaped within the chamber 62.

Figure 6:
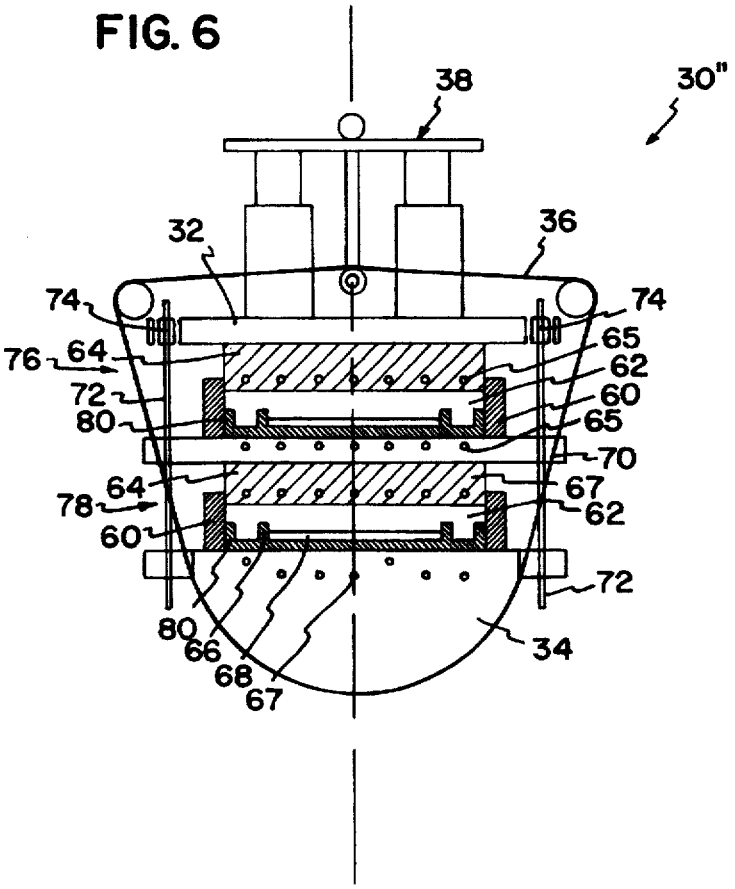
FIG. 6 is another alternative frameless press constructed in accordance with the principles of the present invention, the press being equipped with separate heating and cooling stations.

FIG. 6 shows another press 30" constructed in accordance with the principles of the present invention. Similar to the previously disclosed presses, the press 30" includes top and bottom plates 32 and 34, wrapping structure 36, and lift assembly 38. However, the press 30" also includes an intermediate plate 70 positioned between the top and bottom plates 32 and 34. The plates 32, 34 and 70 are mounted on vertically aligned linear bearings or guide rods 72 that are imbedded in flexible bushings 74 incorporated within the top plate 32. A heating station 76 is located between the top plate 32 and the intermediate plate 70. While a cooling station 78 is located between the intermediate plate 70 and the bottom plate 34.

The heating and cooling stations 76 and 78 of the press 30" include wall structures 60 that are respectively mounted on the lower and intermediate plates 34 and 70. The wall structures 60 define inner chambers 62 sized to slidingly receive press members 64 that are respectively affixed to the top and intermediate plates 32 and 70. Heating elements 65 are mounted at the bottom of the top plate 32 and the top of the intermediate plate 70 for heating material contained within the heating station 76. Conventional cooling elements 67 are mounted in the bottom of the intermediate plate 70 and the top of the bottom plate 34 for cooling material contained within the cooling station 78.

Molding structures such as cutting frames 66 and shaping inserts 68 are positioned within the chambers 62 of the heating and cooling stations 76 and 78. The cutting frames 66 are preferably mounted on trays 80 to facilitate loading and unloading the cutting frames 66 and inserts 68 from the heating and cooling stations 76 and 78.

In use, a tray 80 supporting a cutting frame 66 and a shaping insert 68 is loaded into the heating station 76. Next, material such as thermoplastic composite is placed in the chamber 62 of the heating station 76. The lift assembly 38 is then activated causing the wrapping structure 36 to be tensioned. The wrapping structure 36 exerts closing pressure on the top and bottom plates 32 and 34 such that the plates 32, 34 and 70 are forced together and the thermoplastic composite is heated and formed to a desired shape. After the thermoplastic material is formed, the press 30" is opened and the tray 80 supporting the formed product is transferred from the heating station 76 to the cooling station 78. The heating station 76 is then re-loaded with a new tray 80 and a new batch of thermoplastic material.

Once both the cooling station 78 and the heating station 76 have been loaded, the press 30" is again moved to the closed position such that the previously formed product within the cooling station 78 is cooled and the thermoplastic material within the heating station 76 is formed to a desired shape. The cooled product is then removed from the press 30" and replaced with the newly formed product while the heating station 76 is re-loaded with a new tray 80 and a new batch of thermoplastic material. It will be appreciated that the aforementioned process steps are preferably methodically repeated to systematically generate formed thermoplastic products. The ability to move molds and heated composite material from a permanently heated station to a permanently cooled station during the same cycle results in considerable energy and process-time savings.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. A high pressure press comprising:

first and second opposed plates;

a wrapping structure at least partially surrounding the plates;

a lift unit positioned on one of the first and second plates at a location offset from the wrapping structure; and a linkage structure for transferring a tensioning force generated by the lift unit to the wrapping structure such that the wrapping structure forces the plates together.

2. The press of claim 1, further comprising roller structures for guiding the wrapping structure around corners of the plates.

3. The press of claim 1, wherein the wrapping structure is selected from the group consisting of a belt, a rope or a sheet.

4. The press of claim 1, wherein the linkage structure includes a tensioning member connected to the wrapping structure and generally transversely alignable with respect to the plates, the linkage structure also including a cross member extending between the lift unit and the tensioning member.

5. The press of claim 4, wherein the tensioning member is pivotally moveable relative to the wrapping structure and the cross member.

6. The press of claim 4, wherein the tensioning member has a length that is adjustable.

7. The press of claim 1, wherein the first and second plates define a pressure chamber when the plates are moved together.

8. The press of claim 7, further comprising a molding structure positioned within the pressure chamber.

9. The press of claim 1, further comprising an intermediate plate positioned between the first and second plates.

10. The press of claim 9, wherein the first and intermediate plates define a first pressure chamber and include heating elements for heating the first pressure chamber, and the second and intermediate plates define a second pressure chamber and include cooling elements for cooling the second pressure chamber.

11. A high pressure press comprising:

first and second opposed plates;

a wrapping structure at least partially surrounding the plates;

first and second spaced apart lift units positioned on the first plate at locations offset from the wrapping structure; and a linkage structure positioned between the first and second lift units for transferring tensioning forces generated by the lift units to the wrapping structure such that the wrapping structure forces the plates together.

12. The press of claim 11, further comprising roller structures for guiding the wrapping structure around corners of the plates.

13. The press of claim 11, wherein the wrapping structure is selected from the group consisting of a belt, a rope or a sheet.

14. The press of claim 11, wherein the linkage structure includes a cross member extending between the first and second lift units, and a pivot member extending between the cross member and the wrapping structure, the pivot member being pivotally connected to both the wrapping structure and the cross member.

15. The press of claim 14, wherein the pivot member has a length that is adjustable.

16. The press of claim 11, wherein the first and second plates define a pressure chamber when the plates are moved together.

17. The press of claim 16, further including a molding structure positioned within the pressure chamber.

18. The press of claim 11, further comprising an intermediate plate positioned between the first and second plates.

19. The press of claim 18, wherein the first and intermediate plates define a first pressure chamber and include heating elements for heating the first pressure chamber, and the second and intermediate plates define a second pressure chamber and include cooling elements for cooling the second pressure chamber.

20. A high pressure press comprising:

first and second opposed plates moveable between an open orientation in which the plates are distantly spaced from one another, and a closed orientation in which the plates are proximately spaced from one another;

a wrapping structure at least partially surrounding the plates, a portion of the wrapping structure being substantially parallel to the first plate when the plates are in the open orientation, and forming an oblique angle with respect to the first plate when the plates are in the closed orientation; and a lift unit positioned on the first plate for tensioning the wrapping structure such that the first and second plates are forced together from the open orientation to the closed orientation.

* * * * *